US010037640B2

(12) United States Patent
Gordon

(10) Patent No.: US 10,037,640 B2
(45) **Date of Patent: *Jul. 31, 2018**

(54) SECURE STORAGE DEVICE

(71) Applicant: SneakGuard LLC, Tampa, FL (US)

(72) Inventor: Graeme Gordon, Tampa, FL (US)

(73) Assignee: Sneakguard, LLC, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/860,968

(22) Filed: Jan. 3, 2018

(65) Prior Publication Data

US 2018/0127180 A1 May 10, 2018

Related U.S. Application Data

(63) Continuation-in-part of application No. 15/227,725, filed on Aug. 3, 2016, now Pat. No. 9,911,261.

(60) Provisional application No. 62/200,567, filed on Aug. 3, 2015.

(51) Int. Cl.

| | |
|---|---|
| ***G07C 9/00*** | (2006.01) |
| ***B65D 55/14*** | (2006.01) |
| ***B65D 55/10*** | (2006.01) |
| ***E05B 37/00*** | (2006.01) |
| ***A61J 1/00*** | (2006.01) |
| ***B65D 81/20*** | (2006.01) |

(52) U.S. Cl.

CPC ..... *G07C 9/00142* (2013.01); *A61J 1/00* (2013.01); *B65D 55/10* (2013.01); *B65D 55/14* (2013.01); *B65D 55/145* (2013.01); *B65D 81/2038* (2013.01); *E05B 37/0048* (2013.01); *G07C 9/00158* (2013.01); *G07C 9/00563* (2013.01)

(58) Field of Classification Search

CPC ..... G07C 9/00158; G07C 9/00142; G07C 9/00563; B65D 81/2038; B65D 55/145; B65D 55/14; B65D 81/18; B65D 55/10; A61J 1/00; E05B 37/0048

USPC ..... 340/5.1

See application file for complete search history.

(56) References Cited

U.S. PATENT DOCUMENTS

| | | | | |
|---|---|---|---|---|
| 5,449,230 | A | 9/1995 | Murray | |
| 2017/0036831 | A1 * | 2/2017 | Gordon | G07C 9/00142 |

* cited by examiner

*Primary Examiner* — Ali Neyzari

(74) *Attorney, Agent, or Firm* — Kirby Drake

(57) ABSTRACT

A closure lid attached to a secure storage device for storing material is provided. The closure lid attaches to a storage device that may include a container having a void for external access to the interior space. The closure lid, similarly dimensioned according to the void may be joined to the container and can be manipulated between an open or closed state by utilizing locking tabs. The closure lid may provide an airtight tight without utilizing a vacuum pump. Locking tabs may deploy and retract in the closure lid; the locking tabs may deploy and retract when a one-step operation of applying pressure to the closure lid and turning a control ring clockwise engages and disengages the locking tabs. An access control system is configured to present an input, validate user input, and permit a state change of the lock.

20 Claims, 13 Drawing Sheets

SECURE STORAGE DEVICE

CROSS-REFERENCE TO RELATED APPLICATIONS

This application is a continuation-in-part of U.S. patent application Ser. No. 15/227,725 filed Aug. 3, 2016, which claims the benefit of U.S. Provisional Patent Application No. 62/200,567 filed on Aug. 3, 2015, both of which are incorporated by reference in their entirety.

BACKGROUND

Currently, in the United States, more people are taking medications, vitamins, and using psychoactive plants (e.g., marijuana) than ever before. Although people are consuming medications, vitamins, and psychoactive plants for a wide variety of reasons, personal privacy as well as the safety of others pose unique challenges. Generally speaking, personal privacy is a paramount concern. Not only would it be potentially embarrassing if it became known among friends and family that one is taking medication for anxiety, depression, erectile dysfunction, or a myriad of conditions, the legal issues that could arise if it became a matter of public knowledge could be personally catastrophic. Moreover, the safety of others is also a grave concern. It is difficult to understate the danger of a child opening a pill bottle, purse or other container used to store such material that was inadvertently left out in the open. With the rapid increase in the consumption of psychoactive plant material such as marijuana, such issues are becoming ever more prevalent. Effective means of storage are also an issue and of particular concern in regard to so-called "edibles" like marijuana cookies and the like. Moreover, growers, distributors and producers of marijuana and/or products derived therefrom or other products have a need for secure storage devices to store and transport their products. In addition to the risk of danger and guilt, the potential legal liability that could arise is also staggering. The risk of privacy breach, as well as the risk of access by children and others, is increased outside of the home where safe storage is more difficult, for example, in a car or hotel room or on the beach.

SUMMARY

An embodiment of the present disclosure may provide a secure storage device for securely storing material that may include a container that may have a divider and holders. The container may be dimensioned to fit inside of the secure storage device. A closure lid may be similarly dimensioned to an opening of the container, removable, and may be joined to the container utilizing locking tabs. The secure storage device may also include a control ring that may be configured to turn clockwise when a user applies downward pressure. Additionally, a lock may be provided that may conditionally restrict a change in state via an access control system. The access control system may be configured to present an input and may conditionally allow the lock to change state. The lock may be a friction lock and a mechanical lock. The access control system and the lock amy include a key lock that may be for receipt of a corresponding key as input. The control ring may turn clockwise and may engage and disengage the locking tabs with the container. The secure storage device may also include a lock reset button that may be provided in the closure lid. The lock reset button may be recessed in the closure lid. The access control system may be configured to receive biometric input data from a user, compare the received biometric input data, and transmit permission information to the lock in response to the comparison. The biometric input data may be fingerprint data, and a biometric reader may be provided in the access control system. The container may provide humidity control packs, and the container and the humidity control packs may accommodate smart-enabled electronics.

In another embodiment of the present disclosure, a closure lid for a secure storage device may include an access control system that may be configured to present an input and conditionally allow the lock to change state. The closure lid may also include a combination lock that may be configured to conditionally restrict a change in state via the access control system. The closure lid may include a control ring that may be configured to turn clockwise when a user applies downward pressure. Additionally, the closure lid may include a lock reset button that may be configured in a recessed position in the closure lid, and a plurality of locking tabs that may be configured to deploy and un-deploy from the closure lid. The closure lid may provide an ergonomic design and may be safe to store in a refrigerator. The lock reset button may prevent unintentionally resetting a combination lock password for locking the closure lid. The closure lid may provide humidity control for medications and smart-enabled electronics and may be configured to provide an airtight seal with a container or an object in which the closure lid is applied. The airtight seal may be provided without utilizing an vacuum pump and the closure lid may remain in a sealed position until released by a user. The closure lid may provide an odor-free environment of the container or the object to which the closure lid is applied, and the airtight seal may be a single seal.

In another embodiment, a method for securely storing materials is provided that includes the steps of placing one or more materials into an opening of a secure storage device, wherein the secure storage device includes a closure for accessing the interior space, the closure including an access control system for locking the closure to the secure storage device, securing the closure to the storage device, and activating an access control system thereby locking the closure to the secure storage device.

In some embodiments, the method further includes the step of evacuating air from the interior space. In certain aspects, air is evacuated by engaging a pump positioned within the closure. In another embodiment the pump could be external of the container and may be either manual or electric/battery operated. In this embodiment, the user can create a vacuum by connecting the external pump to the device via a valve.

In certain aspects, the method further includes the step of increasing the pressure within the interior space by activating a pressure release valve positioned within the closure.

It is contemplated that any embodiment of a method or composition described herein can be implemented with respect to any other method or composition described herein.

The use of the word "a" or "an" when used in conjunction with the term "comprising" in the claims and/or the specification may mean "one," but it is also consistent with the meaning of "one or more," "at least one," and "one or more than one."

The use of the term "or" in the claims is used to mean "and/or" unless explicitly indicated to refer to alternatives only or the alternative are mutually exclusive, although the disclosure supports a definition that refers to only alternatives and "and/or."

As used herein, unless otherwise specified or unless the context otherwise clearly requires, "about" regarding a number or measurement means within 10% of the number or measurement.

As used herein, when the term "range" refers to integers, every integer from the minimum to the maximum values of such range is included. In addition, where multiple ranges are provided to describe a concentration or characteristic, such ranges may be combined.

As used in this specification and claim(s), the words "comprising" (and any form of comprising, such as "comprise" and "includes"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

Other objects, features and advantages of the present invention will become apparent from the following detailed description. It should be understood, however, that the detailed description and the specific examples, while indicating specific embodiments of the invention, are given by way of illustration only, since various changes and modifications within the scope of the invention will become apparent to those skilled in the art from this detailed description.

DESCRIPTION OF THE DRAWINGS

The following drawings form part of the present specification and are included to further demonstrate certain aspects of the present invention. The invention may be better understood by reference to one or more of these drawings in combination with the detailed description of the specification embodiments presented herein.

DETAILED DESCRIPTION

The following detailed description describes currently contemplated modes of carrying out exemplary embodiments. The description is not to be taken in a limiting sense, but is made merely for the purpose of illustrating the general principles of some embodiments, as the scope of the disclosure is best defined by the appended claims.

People are naturally curious and like to snoop. However, people also enjoy their privacy, particularly when it comes to medicines and psychoactive substances. They also wish to be responsible and avoid any risk of accidental overdose by curiosity—seekers like children and the uninformed. One way of protecting their privacy while maintaining the safety of others, particularly while away from home, is by storing their medicines and psychoactive substances in a secure storage device (e.g., portable safe) that is suitable for medicines, vitamins, and psychoactive substances. Such substances and materials, particularly psychoactive flora and parts thereof and materials made therefrom, such as foodstuffs, tend to have a limited shelf life and benefit from storage in airtight containers, particularly under reduced air pressure. The present disclosure therefore relates to personal secure storage devices, and more particularly, but not by way of limitation, to a storage device for securing medications, vitamins, and psychoactive plant material and the like.

Various features are described below that can each be used independently of one another or in combination with other features. Broadly, some embodiments generally provide a secure locking storage device that may act as a portable safe. In some embodiments, the secure storage device provides an airtight seal between a closure and the storage compartment and may further allow air to be removed from the storage compartment to create a vacuum seal within the storage device.

Several more detailed embodiments are described in the sections below. Section I provides a general description of an exemplary embodiment of the various components of a secure storage device according to the present disclosure. Section II then describes the operations of the secure storage device. Lastly, Section III describes alternative embodiments of the secure storage device.

I. Secure Storage Device Components

Figure 1:
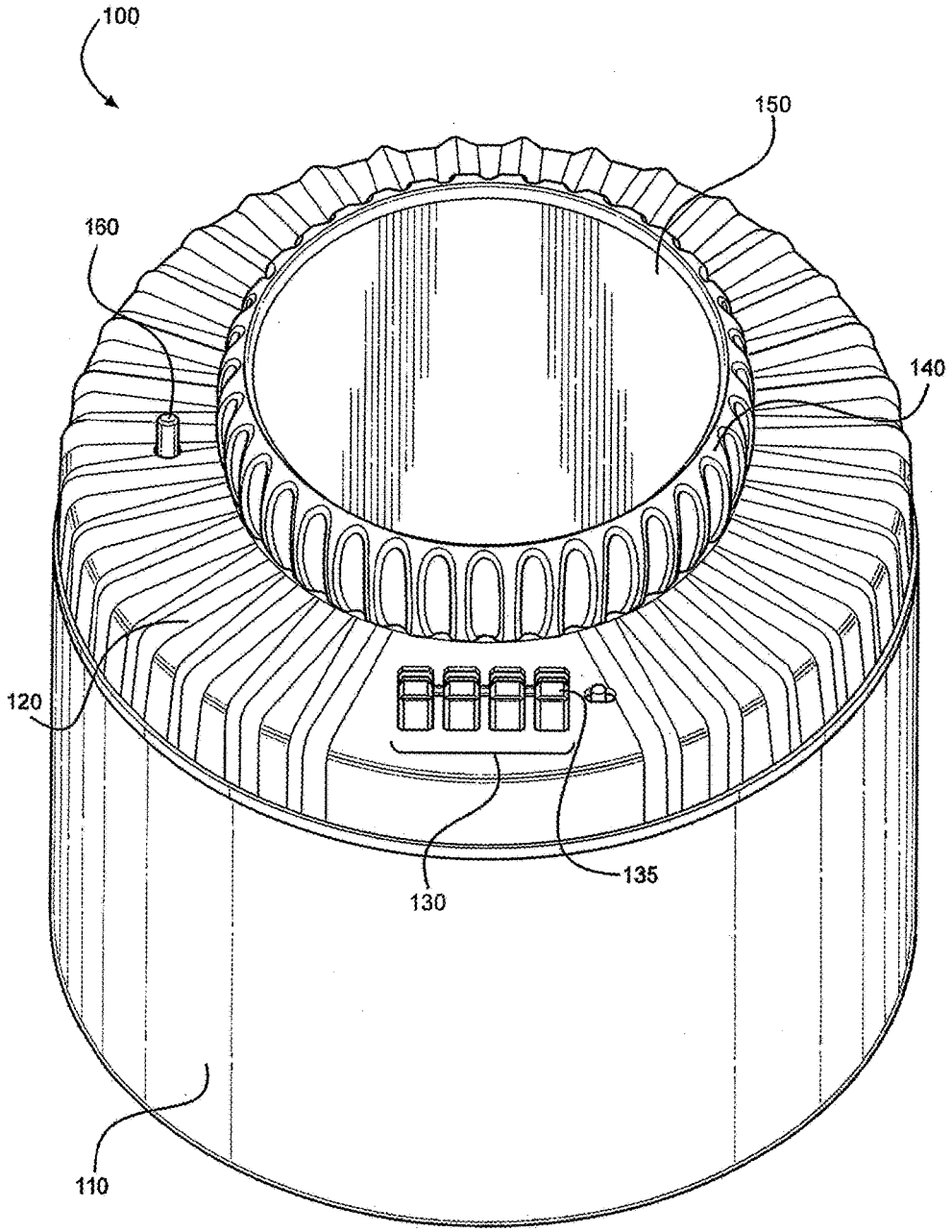
FIG. 1 illustrates a perspective view of a secure storage device according to an embodiment of the present disclosure.

FIG. 1 illustrates a perspective view of an exemplary embodiment of secure storage device 100 according to the present disclosure. Specifically, FIG. 1 shows secure storage device 100 as having two major components: container 110 and closure lid 120. Closure lid 120 may include access control system 130, control ring 140, internal pressure control system 150 (i.e. air evacuation system), and pressure indicator 160.

As illustrated in FIG. 1, access control system 130 of some embodiments may be combination lock 135. Access control system 130 may be operable to maintain a secure coupling of closure lid 120 to container 110. In the depicted configuration, combination lock 135 may be disposed in the top portion of closure lid 120. Combination lock 135 may require appropriate selection of multiple digits as input, such as a 3, 4, 5, 6, 7, 8, 9, 10 or more digits for the lock. In some embodiments, the lock may require a password input that can optionally be reset as needed.

Although the locking mechanism of some embodiments may be mechanical similar to a combination or key lock, other embodiments may include an electrical locking mechanism. Such a locking mechanism may be in communication with access control system 130 for receipt of input in order to enable the coupling of closure lid 120 to container 110 to be detached, thereby providing access to materials stored within.

In some embodiment, an electrical locking mechanism of access control system 130 may be a biometric lock, while some embodiments may use a combination of multiple types of locking mechanisms for increased security. When a biometric lock is used, upon activation, a battery driven motor may drive a metal pin of the locking mechanism in order to secure closure lid 120 to container 110.

Figure 2:
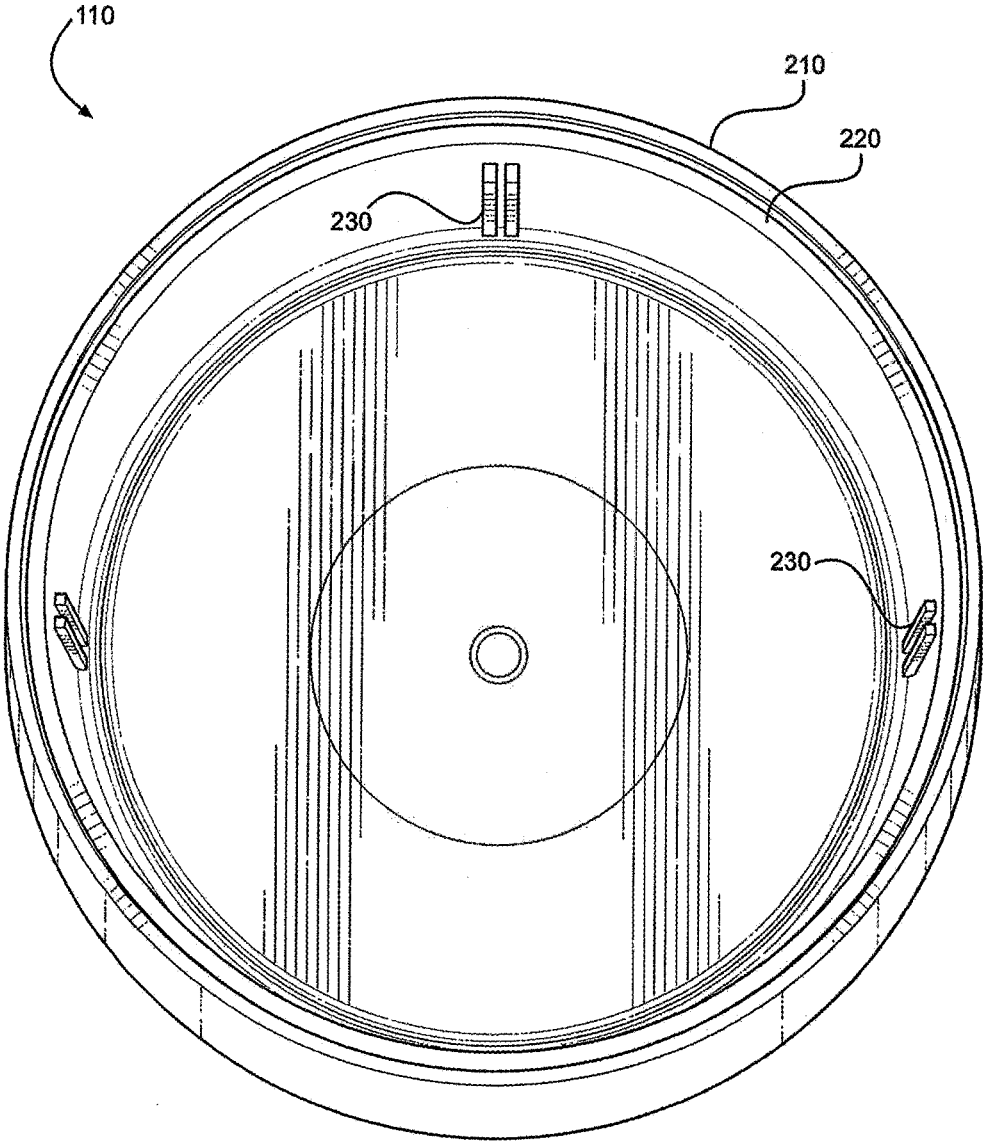
FIG. 2 illustrates an interior view of a container of the secure storage device of FIG. 1 according to an embodiment of the present disclosure.
Figure 3:
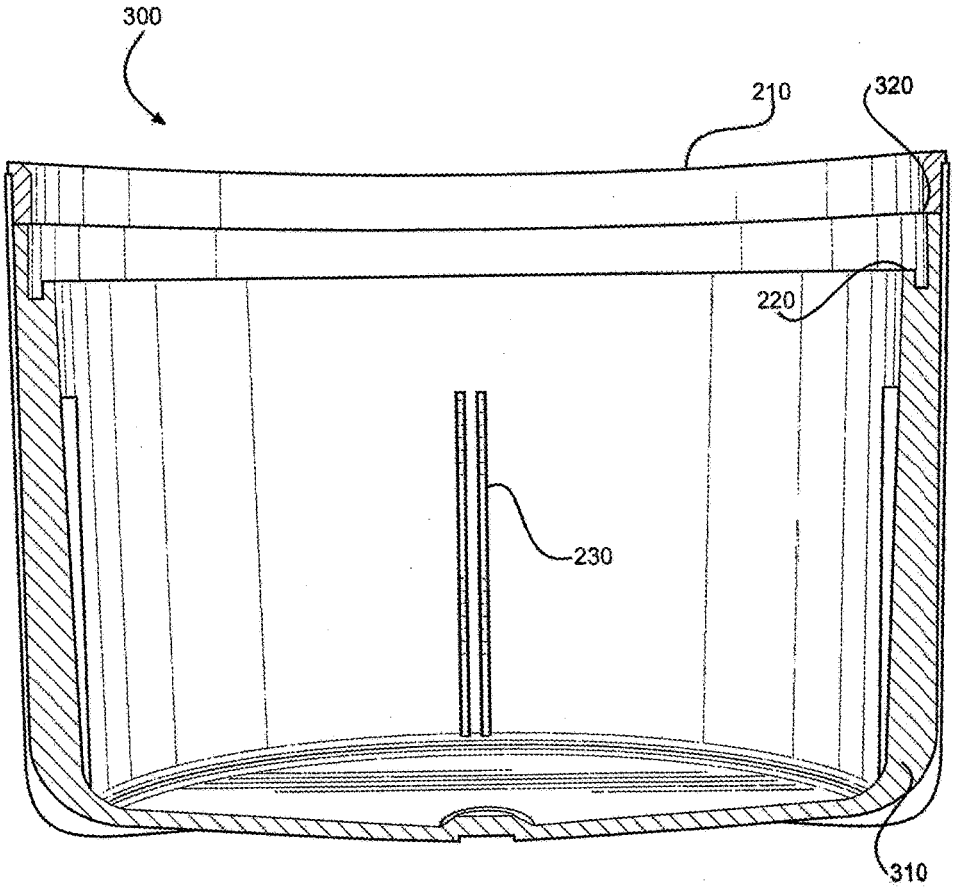
FIG. 3 is a cross-sectional view of the container of FIG. 2 according to an embodiment of the present disclosure.

FIG. 2 illustrates an interior view of container 110 of secure storage device 100. As illustrated, container 110 includes an outer circumference presenting an enclosure about an interior space, the outer circumference having a void for external access to the interior space. Container 110 may include rim 210 along the top edge of container 110, shelf 220, and divider tracks 230. FIG. 3 illustrates cross-sectional view 300 of container 110 showing rim 210, shelf 220, and divider tracks 230 along with air gap 310 between outer and inner walls of container 110. As illustrated in FIG. 3, some embodiments of the container may include a double wall having air gap 310 between the two walls of container 110. Such a configuration may provide exceptional insulation for the materials stored within container 110.

The internal space of container 110 may be substantially cylindrical and has at least one opening for receiving various materials or small canisters of materials. In some embodiments, the internal space may be of substantially varied proportions as long the space is sufficiently sized to receive various materials. Different embodiments may be produced where the width of the outer circumference of container 110 is uniform or irregular along its longitudinal extent. For example, the outer circumference may have a wider bottom portion, a narrower throat portion, and a wider top portion. In some embodiments, the circumference of the top and bottom portions of the container 110 may be approximately the same.

The different elements of container 110 described above allow for one or more airtight seals to be formed between container 110 and closure lid 120. For example, rim 210 along the top edge of the circumference of container 110 may have ledge 320 near bottom of rim 210 that engages with a seal element of closure lid 120 to form a friction lock when secure storage device 100 is in a secured and sealed state. Shelf 220 extends axially upward about the opening of the internal space of container 110 so closure lid 120 may rest on the shelf and form another seal. The operation of these seals and interactions of container 110 and closure lid 120 will be discussed in further detail below.

Figure 4:
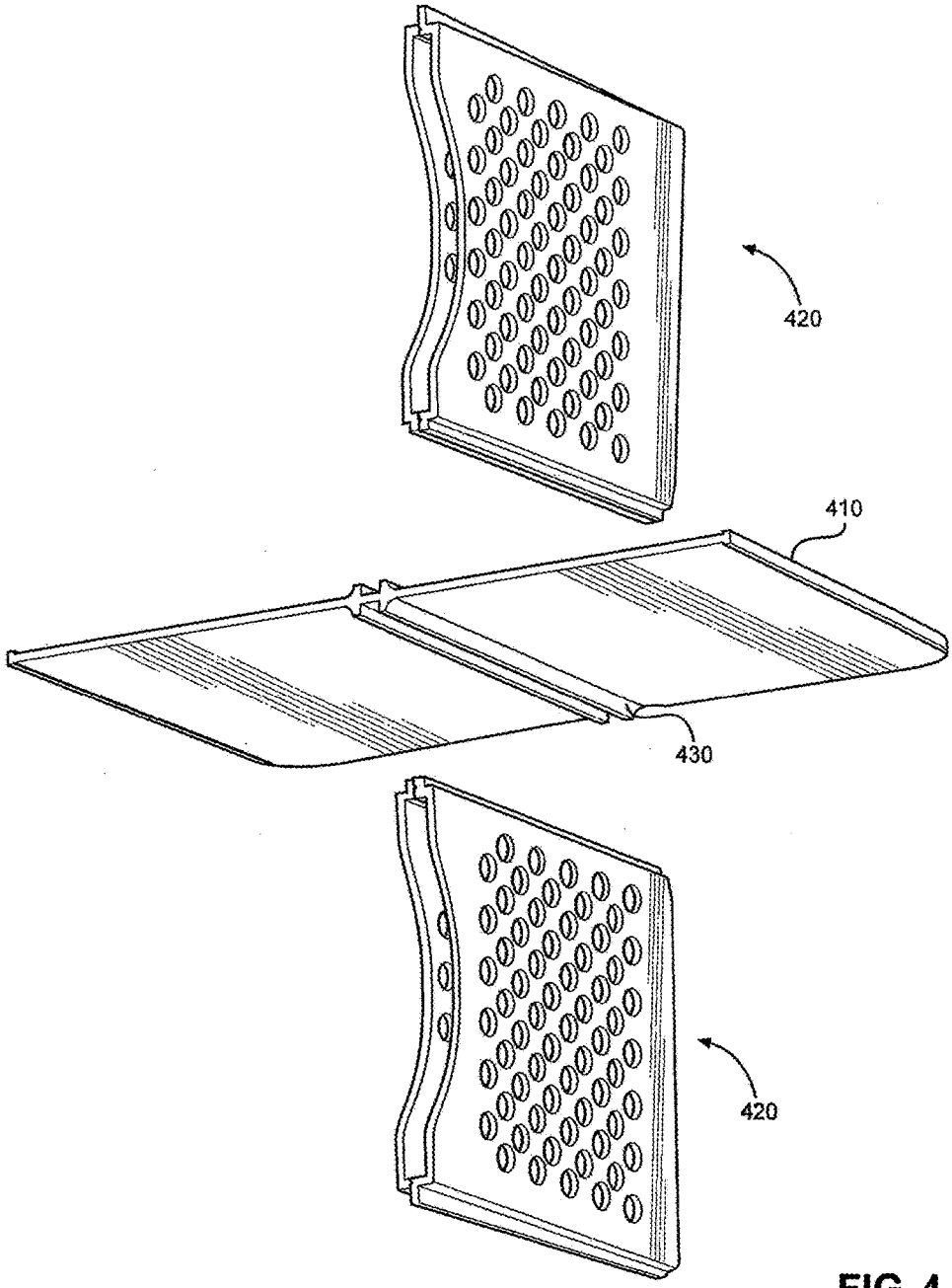
FIG. 4 illustrates configurable dividers that may be used to create separate compartments within the storage container of FIG. 2 according to an embodiment of the present disclosure.

Container 110 may further comprise one or more configurable dividers 410 and 420 as depicted in FIG. 4. Dividers 410 and 420 may be used for protecting and/or isolating different materials stored in container 110. Configurable dividers 410 and 420 may be secured within container 110 via divider tracks 230 found along the interior wall of container 110. For example, first divider 410 may span the internal diameter of container 110 to form two separate sections within container 110. Second divider 420 may extend from an interior wall of container 110 to first divider 410, which may have divider track 430 along its center. Secondary dividers 420 may be able to accept individual environmental control packs, such as humidification or dehumidification packs. In an embodiment, dividers 410 and 420 are substantially the same dimensions as the width and depth of the internal space, although other dimensions may be desirable. Some embodiments of dividers 410 and 420 may further include pockets and storage spaces for additional materials. In some embodiments, a divider may separate the longitudinal extent of the internal space into four compartments. Of course, fewer or more compartments may be provided by omission or addition of separators. The dividers may also take the form of a drawer and the like.

Figure 5:
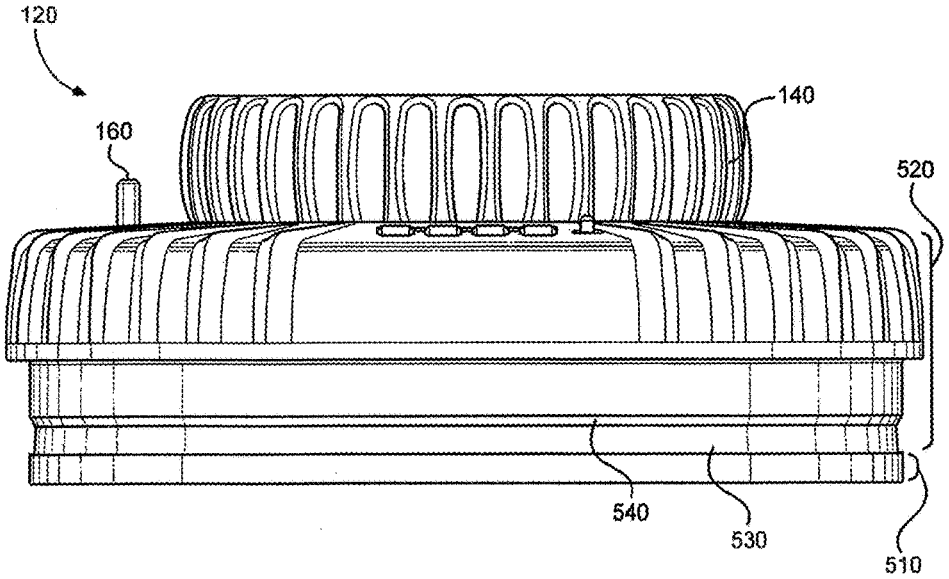
FIG. 5 illustrates a side view of the closure of the secure storage device of FIG. 1 according to an embodiment of the present disclosure.

FIG. 5 illustrates a side view of closure lid 120. As shown, closure lid 120 may include lower closure assembly 510, upper closure assembly 520, control ring 140, and an internal pressure control system (not shown). Upper closure assembly 520 may include elastic seal 530 that engages with rim 210 of container 110 at the rim's lower ledge 320 as previously described. This engagement may occur when elastic seal 530 is forced upward and deformed past narrowing lip 540 of upper closure assembly 520.

Figure 6:
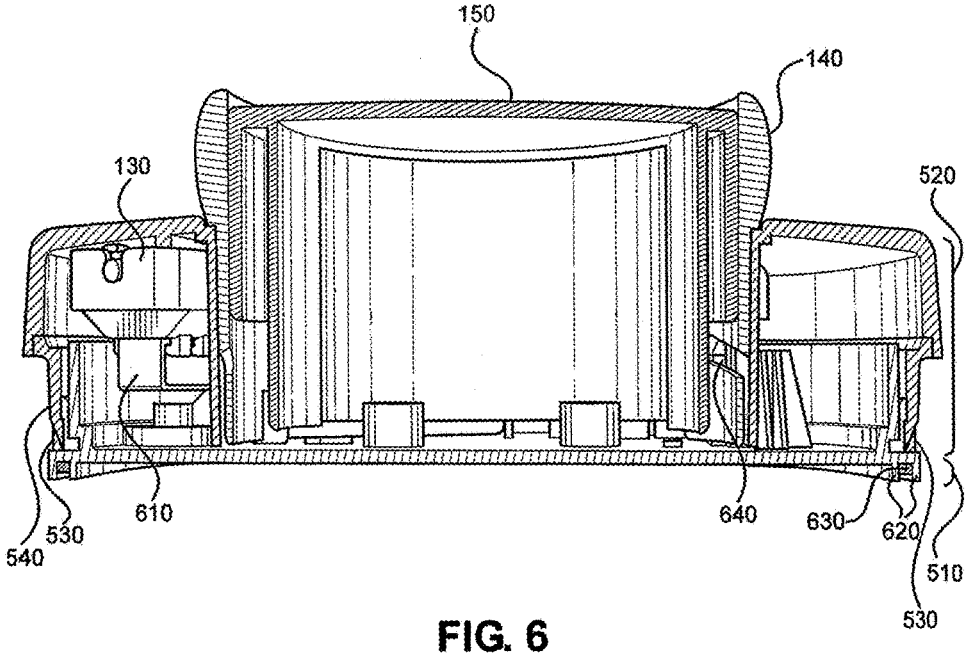
FIG. 6 is a cross-sectional view of the closure of FIG. 5 according to an embodiment of the present disclosure.

Next, FIG. 6 illustrates a cross-sectional view of closure lid 120 shown in FIG. 5. The cross-sectional view reveals how upper closure assembly 520 and lower closure assembly 510 are positioned relative to each other. Access control system 130 is also shown with locking pin 610 that that is moveable when access control system 130 is in an unlocked setting and fixed when access control system 130 is in a locked and secure setting.

Lower closure assembly 510 may include groove 620 that forms a recess around the circumference of lower closure assembly 510. The recess formed by groove 620 may include main seal 630 (e.g., gasket) that sits within the recess around the circumference of lower closure assembly 510. In some embodiments, main seal 630 may be made of silicon. Groove 620 may be adapted to rest on shelf 220 of container 110 and an airtight seal may be formed between container 110 and closure lid 120 via main seal 630 disposed within groove 620.

Control ring 140 and internal pressure control system 150 may also make up parts of upper closure assembly 520. In the cross-sectional view of closure lid 120, control ring 140 is shown to include at least one guide slot 640, around a lower portion of control ring 140. Guide slot 640 may be coupled to one or more fixed protrusions 840 (shown in FIG. 8) that extend upwardly from bottom closure assembly 510. As the control ring of some embodiments is turned by a user, fixed protrusions 840 may travel along guide slot 640 causing the lower assembly to move upward toward upper closure assembly 520 or downward and away from upper closure assembly 520. Some embodiments may use multiple guide slots 640, preferably four, around control ring 140 to engage with lower assembly fixed protrusions 840 so the upward and downward movement of lower closure assembly 510 occurs smoothly along a vertical axis of closure lid 120.

Figure 7:
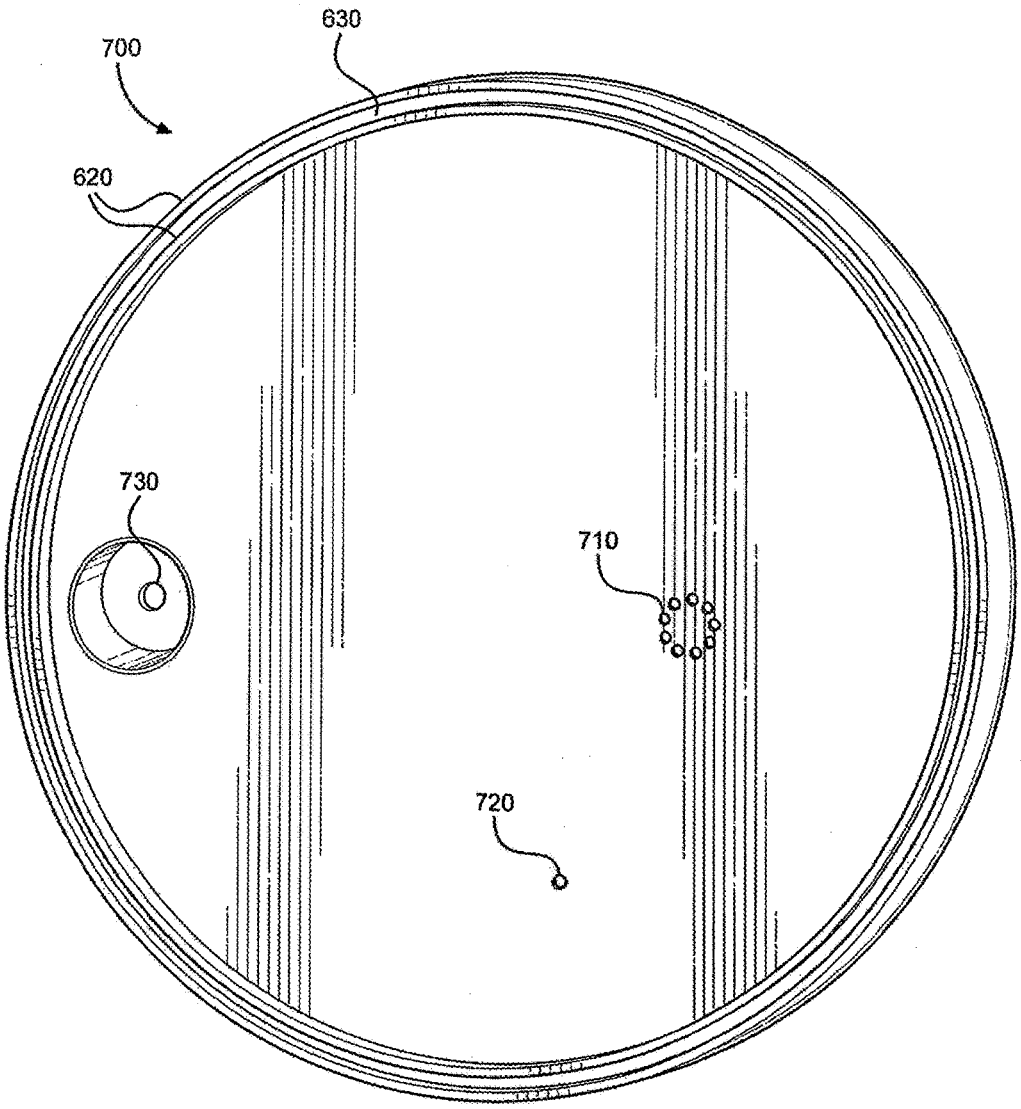
FIG. 7 illustrates the bottom of the closure of FIG. 5 according to an embodiment of the present disclosure.

FIG. 7 illustrates bottom underside 700 of closure lid 120, and more specifically, lower closure assembly 510. Underside 700 of closure lid 120 includes groove 620 around the circumference of closure lid 120, main seal 630 disposed between groove 620, air intake 710, pressure release aperture 720, and pressure indicator valve 730.

Figure 8:
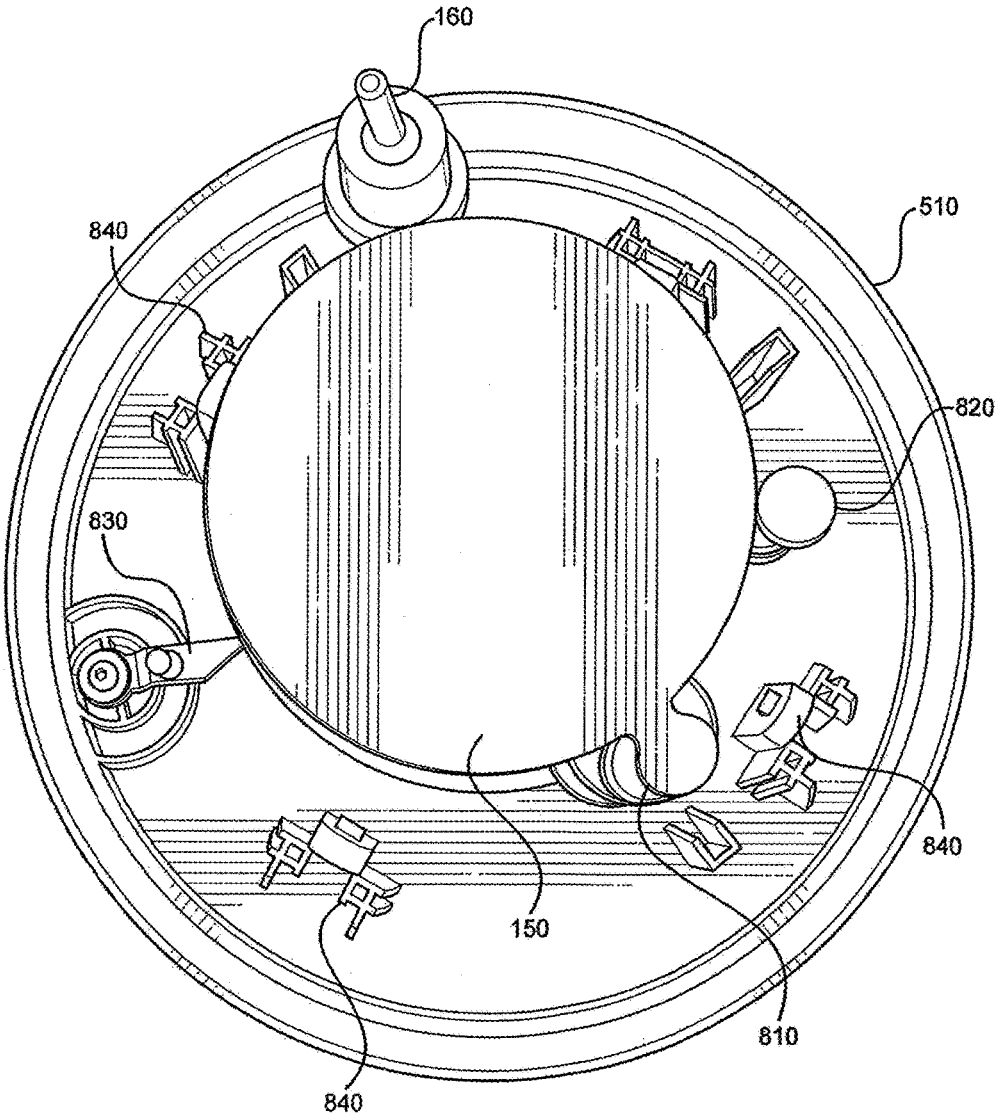
FIG. 8 illustrates a lower closure assembly according to an embodiment of the present disclosure.

FIG. 8 illustrates an exemplary embodiment of lower closure assembly 510. As shown, lower closure assembly 510 may include internal pressure control system 150, pressure indicator 160, fluid communication intake channel 810, air pressure release valve 820, tongue 830, and fixed protrusions 840. Air pressure release valve 820 may include a spring and plug which seals and unseals pressure release aperture 720 when the secure storage device is in a closed and open state, respectively, thereby enabling air flow between an exterior and interior space of pressure control system 150. Tongue 830 is pivotable and acts in conjunction with locking pin 610 as part of access control system 130.

The different components of some embodiments of secure storage device 100 may be injection molded, and may be made of any suitable, durable thermoplastic polymeric material. Acrylic plastics, polycarbonates, durable metals, corrosion-resistant materials such as aluminum, stainless steel, glass and composites thereof may be used. In some embodiments, the interior may be plastic while the exterior may be a different material, such as a metal. In some embodiments, the exterior may be stainless steel. The plastic material of some embodiments may be food-grade material suitable for the storage of pharmaceuticals and plant materials. The various seals may be made from a suitable elastic material including natural latex rubber in addition to synthetic materials, such as styrene ethylene butadiene, styrene butadiene, polychloroprene (Neoprene), nitrile rubber, vinyl, and the like. Storage device 100 may also have an exterior surface that is made from thermally resistant material so storage device 100 may find use in a variety of temperatures, such as room temperature to between 0° C.-40° C., or 3° C. to 30° C., or 5° C. to 25° C. Thus, the container may find a particular use for storing materials in a refrigerator.

II. Operation of the Secure Storage Device

Operating the vacuum seal and security functionalities of an exemplary embodiment of secure storage device 100 will now be described. In the exemplary secure storage embodiment referenced in FIG. 1-FIG. 8, closure lid 120 is operable to create a friction lock with container 110. The friction lock configuration of this embodiment includes control ring 140 integrated into closure lid 120.

Control ring 140 is operable to permit user manipulation of locking pin 610 from open to closed state, subject to access control system 130. Control ring 140 may be integrated into the outer periphery of closure lid 120 as a cylindrical portion of it. In an exemplary configuration, control ring 140 may have a height of about one inch and may include a textured ergonomic surface for ease of use. Control ring 140 may be slidably integrated such that a user may rotate the control ring, clockwise or counterclockwise, in order to engage or disengage tongue 830 with control ring 140 and simultaneously engage a friction lock between closure lid 120 and container 110. Control ring 140 is engaged with at least one tongue 830 such that rotation of control ring 140 in one direction extends tongue 830 and rotation in the opposite direction retracts tongue 830.

When access control system 130 is in an unlocked state, locking pin 610 is free to move. Accordingly, tongue 830, which engaged with locking pin 619, is also free to move between the extended and retracted position as control ring 140 is rotated between the unlocked and locked positions.

When access control system 130 is in a locked state (e.g., scrambling combination lock 135), locking pin 610 unable to move and tongue 830 is extended into a notch of control ring 140. With locked tongue 830 engaged with control ring 140, rotation of control ring 140 is not possible, thereby providing security for the materials or items stored within secure storage device 100.

Upper closure assembly 520 includes narrowing lip 540, and elastic seal 530 is disposed below narrowing lip 540 bounded by the outer circumference of the lower portion of upper closure assembly 520. Elastic seal 530 has a relaxed width slightly less than the width of narrowing lip 540 and a tensioned width greater than the width of narrowing lip 540. As mentioned, control ring 140 is cooperatively joined with one or more tongues 830 such that rotation of control ring 140 in one direction extends tongue 830.

In an exemplary operation, closure lid 120 is placed on container 110 by resting main seal 630 between grooves 620 of lower closure assembly 510 on shelf 220 of container 110. Next, closure lid 120 may be engaged via a friction lock to the inner circumference of container 110 to form an airtight seal between closure lid 120 and container 110.

The friction lock is formed when control ring 140 is rotated to a locked position, which causes lower closure assembly 510 and upper closure assembly 520 to move toward each other. Specifically, this occurs as fixed protrusions 840 of lower closure assembly 510 move along guide slots 640 of control ring 140, where guide slots 640 pull fixed protrusions 840 upward along with entire lower closure assembly 510 as control ring 140 is rotated. This movement forces elastic seal 530 upward causing elastic seal 530 to deform outwardly and expand past narrowing lip 540. Expanded elastic seal 530 contacts the inner wall of container 110, specifically ledge 320 of rim 210, whereby elastic seal 530 provides frictional locking. Thereafter, control ring 140 can provide mechanical locking via access control system 130 finalizing a secure and airtight seal lock for storage device 100.

Furthermore, a vacuum seal may also serve to lock closure lid 120 to container 110. Accordingly, the secure and airtight seal lock may in essence be a redundant locking mechanism. In one embodiment, the container can be locked without a vacuum but remains airtight. In this embodiment, the control ring may be turned such that the seal lock is engaged and moves a metal tongue into the control ring. Once the seal is engaged the lid will not readily be removed from the container. For additional security, access control system 130, such as combination lock 135, biometric lock and the like, may be used to prevent the control ring from releasing the seal. For embodiments that include a biometric lock, upon activation a battery driven motor may drive a metal pin in to control ring 140 to prevent it from moving.

When a vacuum is desired, air may be evacuated from container 110 prior to or after locking via access control system 130 after an airtight seal is engaged via the friction lock. Engaging the friction lock occurs when upper and lower closure assemblies 520, 510 are moved toward each other. In this position, air pressure release valve 820 is depressed and has plugged pressure release aperture 720. Internal pressure control system 150 (e.g. a vacuum system) that may be integrated into closure lid 120 can then evacuate the air from inside container 110 as well as maintain a seal.

In some embodiments, internal pressure control system 150 may be a pump that pulls air out of container 110 via air intake 710 and fluid communication channel 810 and out of closure 110. With each movement of the pump, the air pressure in sealed container 110 may decrease about 5, 10, 15, 20, 25, 30 or more millimeters of mercury (mm Hg). As air is removed from the container, pressure indicator 160 will be pulled in to pressure indicator valve 730. Once pressure indicator 160 has dropped fully and is flush with closure lid 120, a vacuum within the container has been achieved. The vacuum pressure further enhances the effectiveness of main seal 630 between groove 620 and shelf 220 of container 110. To release the vacuum, air needs to flow into the container via pressure release aperture 720. Accordingly, air pressure release valve 820 must unplug pressure release aperture 720. This is achieved when tension from a spring coupled to a plug of pressure release valve 820 is released by rotating control ring 140 so upper and lower closure assemblies 520, 510 can move apart thereby causing pressure release valve 820 to unplug pressure release aperture 720. Once container 110 has lost pressure, it will remain in a locked state until access control system 130 is unlocked (e.g., entering in the correct code on combination lock 135) and control ring 140 is manipulated to the open position thereby retracting tongue 830.

The foregoing relates to illustrative details of one or more exemplary embodiments of the present disclosure and modifications may be made without departing from the scope of the disclosure.

III. Alternative Embodiments of the Secure Storage Device

Secure storage device 100 may act as a portable safe where container 110 has an interior space in which various materials (e.g., medicines, psychoactive substances, or valuables) may be contained. Container 110 may be sized and shaped so that multiple canisters (e.g., medicine bottles) of various sizes may fit inside. In some embodiments, closure lid 120 may be removable to provide access to the interior space, while other embodiments may include a closure lid that is joined to container 110 so the closure lid is moveable between an open position and a closed position via a pivot motion or a hinged motion.

Furthermore, different embodiments of portable container 110 may include various shapes of various dimensions. For example, different embodiments of a container may be rectangular, oval, etc. Portable secure storage devices may include any suitable dimensions for storing a variety of materials with exemplary dimensions (height×width×length) including but are not limited to 4 inches×9 inches×12 inches, 4 inches×4 inches×3 inches, 6 inches×inches 6 inches×3 inches, and 9 inches×9 inches×4 inches, or dimensions within the ranges defined by those exemplary dimensions.

Figure 9:
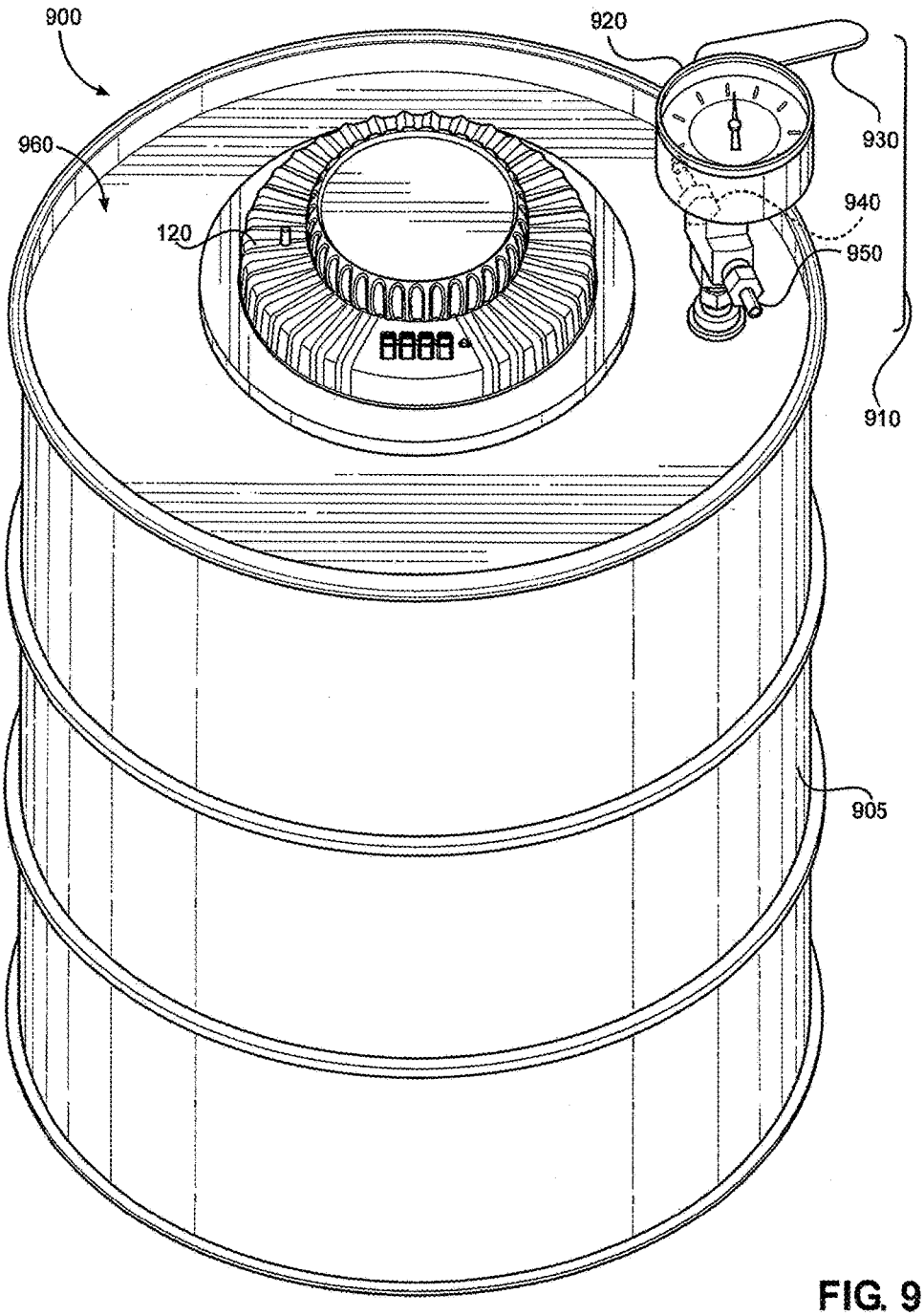
FIG. 9 is a perspective view of a large capacity secure storage container according to an embodiment of the present disclosure.

FIG. 9 illustrates a perspective view of another alternative embodiment for large capacity secure storage container system 900 according to the present disclosure. This embodiment may include secure storage closure lid 120 integrated into large capacity storage container 905. Some embodiments of large capacity secure storage container system 900 may include lid 960 that is removable and lockable while other embodiments may only provide lid 960 in an integrated position that may be part of large capacity storage container 905 and cannot be removed. Valve assembly 910 may also be provided in the large capacity embodiment. Valve assembly 910 may include pressure gauge/indicator 920, handle 930, input valve 940, and pressure release valve 950. Pressure gauge/indicator 920 may be used to read the current pressure within large capacity storage container 905. Handle 930 may be used to open valve assembly 910 to large capacity storage container 905 so that gases may be introduced via input valve 940. Pressure release valve 950 may be used to release pressure from within the large capacity storage container 905. Valve assembly 910 is only one exemplary embodiment and may other varieties and types of valve assemblies may be used in conjunction with large capacity secure storage container system 900 without departing from the scope of the embodiment. Different embodiments may also place the location of valve assembly 910 in different locations of large capacity secure storage container system 900. Some embodiments may also be configured so multiple large capacity secure storage containers may be stacked upon each other. Furthermore, some embodiments of large capacity secure storage container system 900 may include an epoxy phenolic liner for food grade safe storage within large capacity storage container 905.

Figure 10:
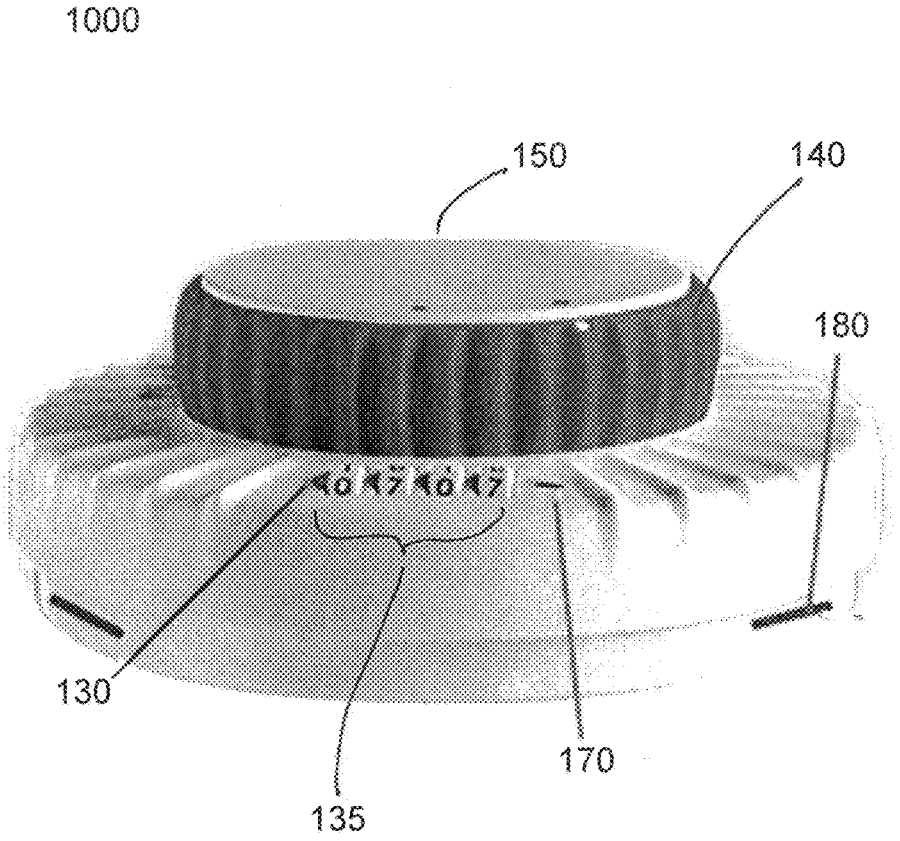
FIG. 10 illustrates a perspective view of a closure of a secure storage device according to the present disclosure.

FIG. 10 illustrates a perspective view of an embodiment of closure lid 1000 of a secure storage device according to an embodiment of the present disclosure. As shown, closure lid 1000 may include access control system 130, combination lock 135, control ring 140, an internal pressure control system (not shown), lock reset button 170, and locking tabs 180. Access control system 130 may be operable to maintain a secure coupling of closure lid 1000 to a container. Control ring 140 may turn clockwise when a user applies slight downward pressure to closure lid 1000. By applying downward pressure and turning control ring 140 clockwise, locking tabs 180 may engage with a container, and closure lid 1000 may be secured to the container and form an airtight seal. Combination lock 135 may be disposed in the top portion of closure lid 1000. Combination lock 135 may require an appropriate selection of multiple digits as input, such as a 3, 4, 5, 6, 7, 8, 9, 10 or more digits for locking closure lid 1000 with a container. Receipt of manipulated dials corresponding to alphanumeric input may be provided by combination lock 135. In some embodiments, combination lock 135 may require a password input that may be optionally reset as needed. It should be appreciated that combination lock 135 may include a four-digit combination. Combination lock 135 may prevent control ring 140 from turning and may effectively block retraction of locking tabs 180 that may engage with a container and lock closure lid 1000 to the container. Locking tabs 180 may provide three locking tabs that may engage a container and lock closure lid 1000 to the container. It should be appreciated that more or less than three locking tabs may be provided in closure lid 1000 without departing from the present disclosure. Lock reset button 170 may be recessed in an upper portion of closure lid 1000. A recessed position of lock reset button 170 may prevent unintended password or combination code resets.

In some embodiments, closure lid 1000 may eliminate a vacuum or vacuum pump, while maintaining an airtight seal, and may provide a one-step control ring 140 that may engage locking tabs 180. Closure lid 1000 may provide increased security and may not include cables or lock shanks for thieves to severe or cut. It should be appreciated that an indicator which may indicate an unlocked and locked status may be provided. It should also be appreciated that closure lid 1000 and/or a compatible secure storage device may not include any stainless steel. It should also be appreciated that an outer shell of a secure storage device may not include any stainless steel.

Figure 11:
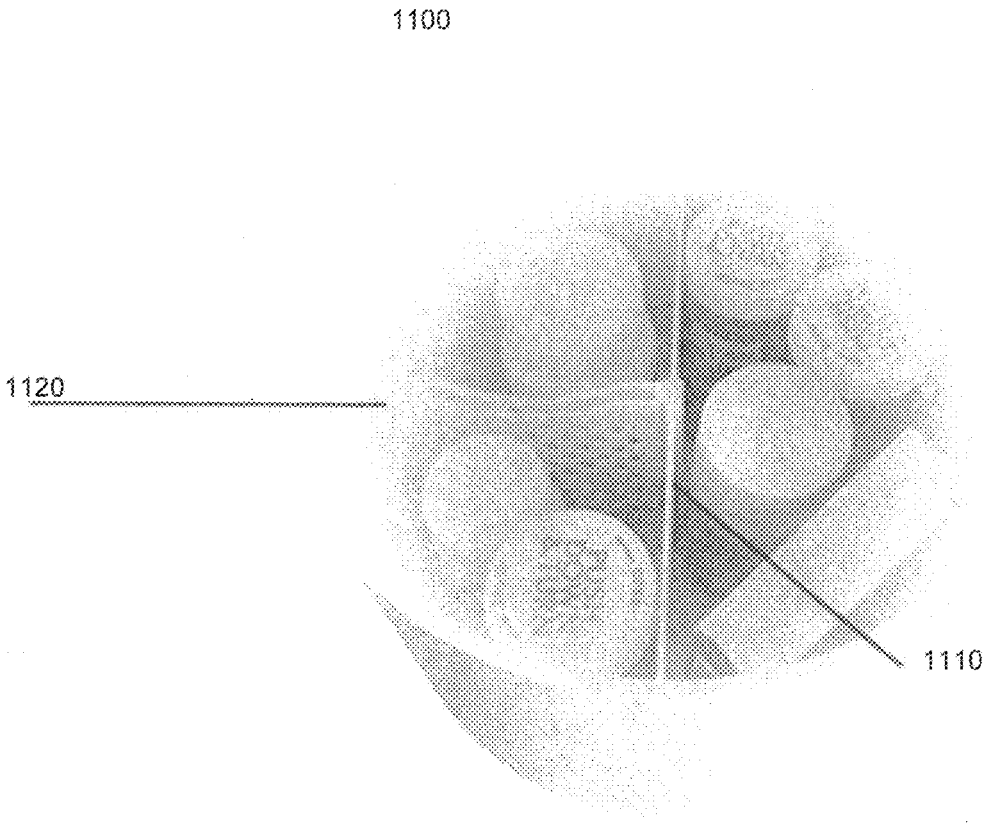
FIG. 11 illustrates a perspective view of a container of a secure storage device according to an embodiment of the present disclosure.

FIG. 11 illustrates container 1100 of a secure storage device according to an embodiment of the present disclosure. As illustrated, container 1100 may include divider 1110 and divider holders or humiddicant holders 1120. Container 1100, divider 1110, and/or holders 1120 may be made of plastic or BPA-free plastic. Container 1100, divider 1110, and holders 1120 may control humidity. Humidity control packs may also be provided. It should be appreciated that container 1100 may accommodate items or accessories including, but not limited to, smart-enabled electronics that communicate through cellular and/or wireless networks. Container 1100 may also provide a capacity that may accommodate most common pill bottle sizes. It should be appreciated that container 1100 may provide a tall structure that may provide an increased capacity.

Figure 12A:
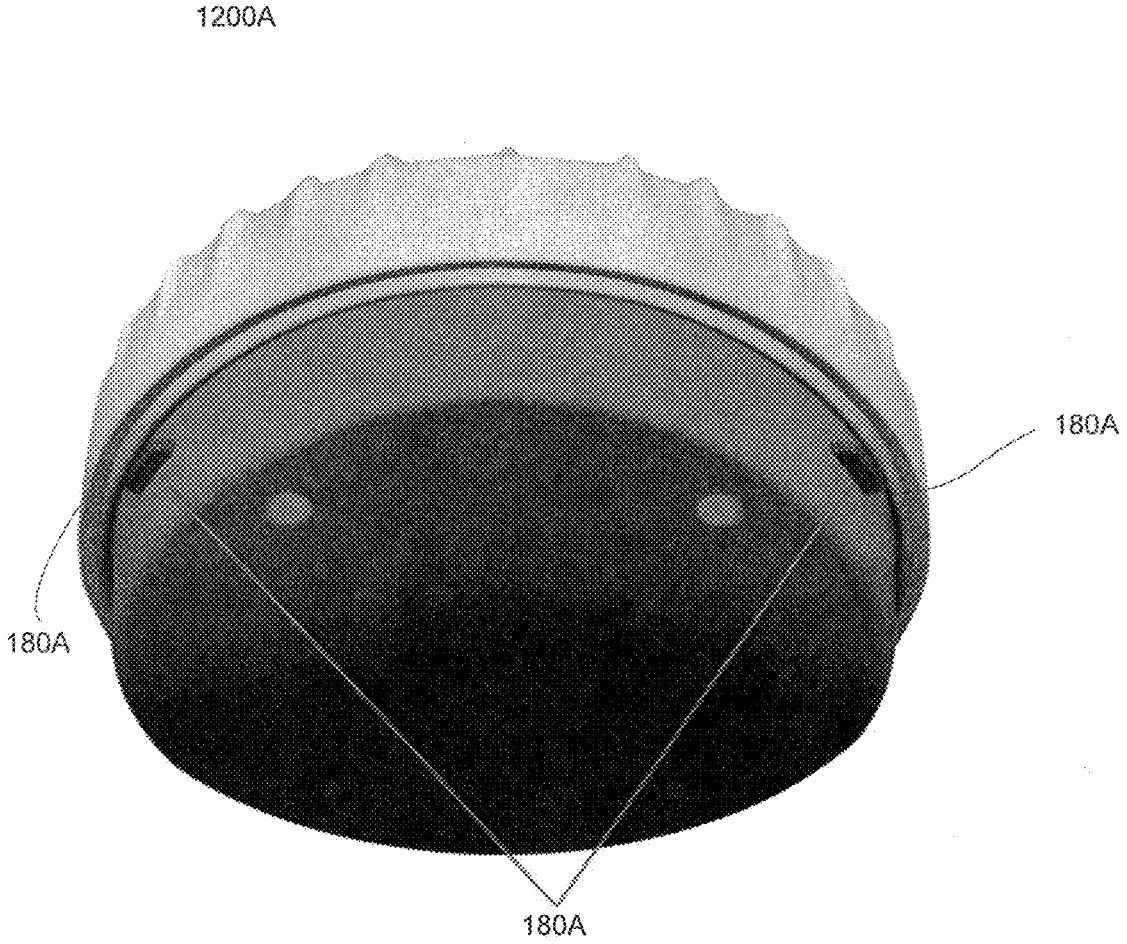
FIG. 12A illustrates a perspective view of the closure of FIG. 10 according to an embodiment of the present disclosure.
Figure 12B:
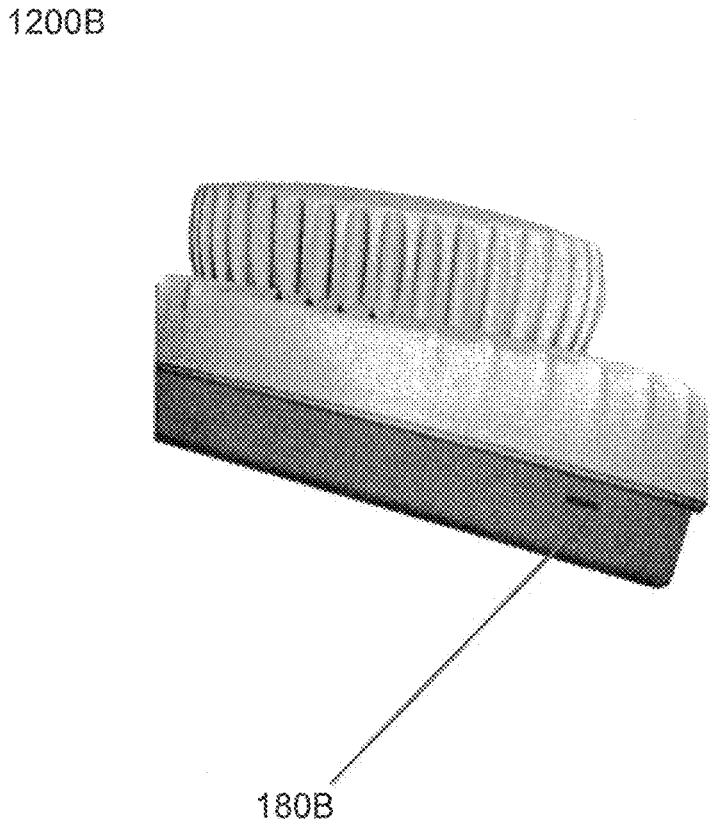
FIG. 12B illustrates another perspective view of the closure of FIG. 10 according to an embodiment of the present disclosure.

FIGS. 12A and 12B illustrate closure lids 1200A, 1200B, respectively, of a secure storage device according to an embodiment of the present disclosure. Closure lid 1200A (FIG. 12A) may provide locking tabs 180A (FIG. 12A) that may be in a deployed position. In the deployed position, locking tabs 180A (FIG. 12A) may be successfully deployed, such that a seal engages with a secure storage device to maintain an airtight vacuum seal. Closure lid 1200B (FIG. 12B) may provide locking tabs 180B (FIG. 12B) that may be in an un-deployed or unlocked position. In the un-deployed or unlocked position, locking tabs 180B (FIG. 12B) may be successfully un-deployed or unlocked, such that a seal releases or unlocked from secure storage device to open or remove closure lid 1200B (FIG. 12B) from a secure storage device. It should be appreciated that a one-step operation may be provided in which control ring 140 be utilized to engage and disengage locking tabs 180A, 180B. It should also be appreciated that a single seal may create an airtight seal of closure lid 1200A, 1200B with a secure storage device. It should further be appreciated that only one seal may be required to secure closure lid 1200A, 1200B with a secure storage device.

Figure 13:
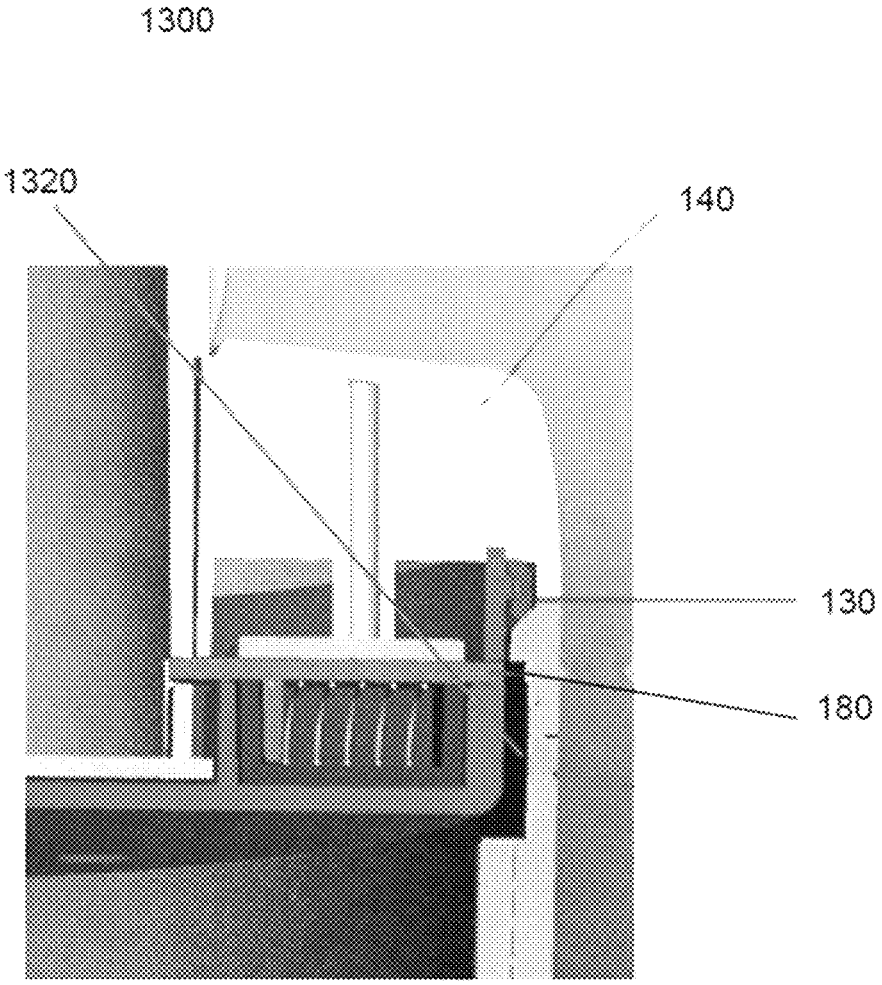
FIG. 13 illustrates a cross sectional view of the closure of FIG. 10 according to an embodiment of the present disclosure.

FIG. 13 illustrates a cross-sectional view of closure lid 1300 according to an embodiment of the present disclosure. Circumference seal 1310 may create an airtight seal when downward pressure is applied by the user to closure lid 1300 and control ring 140 is turned clockwise. Turning control ring 140 clockwise may cause locking tabs 180 to deploy under inner container ledge channel 1320.

It should be appreciated that a secure storage device and component thereof, including, but not limited to, a closure lid and a container, may be smell-proof and be made of BPA-free plastic. It should also be appreciated that a secure storage device and component thereof may be safe for food and other consumable products. A secure storage device and component thereof may provide an ergonomic design that may be refrigerator-safe.

Different embodiments of the control ring may also be possible within the scope of this disclosure. For example, an alternative embodiment of a control ring may be cooperatively joined with one or more tabs such that rotation of the control ring in one direction extends the tabs and rotation in the opposite direction retracts the tabs. The one or more tabs may be disposed below the control ring. In this configuration, a section of a container may include locking slots. The locking slots may be disposed directly the outer circumference or in walls nested in the internal space of the container. The locking slots may be disposed inline with the path of extension of the tabs. Rotation of the control ring in one direction of this embodiment may extend the tabs to the inline locking slots. In exemplary operation, the closure lid may become engaged to the container such that the tabs are in the internal space of the container. Rotating the control ring may extend the tabs outward. In turn, the tabs may extend through the locking slots to provide mechanical locking. This can further be secured by using a lock, such as but not limited to combination lock, key lock, biometric and the like.

The access control system of some embodiments may be operable to receive input and permit or signal a lock to change from a closed to open state (and vice versa). The access control system may be mechanical or electrical and may include an electronic port for permitting access or programming the system. Some embodiments of the access control system comprise at least one input for conditional access to an authorized user and denying access to an unauthorized user where the authorized user engages the access control system to open the closure lid of the secure storage device, which thereby allows external access to the internal space of the container. It is within the scope of this disclosure to incorporate one or more elements into the access control system design.

In one embodiment, the access control system may include a key lock for manually locking the closure lid to a closed position, and/or an electronic controller for opening the closure lid by an authorized person after being positively identified. A key may be presented and inserted into a key lock as the input. In an exemplary embodiment with a manual lock, the access control system is integral and a valid key permits manual manipulation of a fastener of the lock in order to change the container from a closed to open state. In an exemplary embodiment with an electronic lock, the access control system may be external to the lock and upon valid key input, the access control system may signal the electronic lock for actuation of a fastener of the lock in order to change the container from a closed to open state.

A key lock may be a back up for manually locking the closure lid to a closed position and/or manually unlocking the closure lid to an open position. The key lock may physically engage the body of the storage device, such as by extendable pins that are received by the safe body, or alternatively, the key lock may activate a magnetic seal in which case the body will include magnetically chargeable/charged area sufficient to hold the closure lid in a closed position.

In a further or alternate embodiment of the present disclosure, the lock may include wired or remote wireless modules such as infrared, RFID, Bluetooth, Wi-Fi, firewire port, USB port, near field communication (NFC), beacon technology, or others known in the art. The lock may receive instructions to actuate and thus lock or unlock and/or to move a closure lid to an open or closed position. For example, some embodiment of the access control system may be accessible over a network or hard wire via a computer such as a smartphone. A mobile phone input may receive user input and conditionally relay instructions to the lock in response to the input. The remote wireless or hard wired unit may contain a phone application by which the user utilizing the mobile phone inputs a code, fingerprint recognition of the user, or other security application which enables the remote wireless or hard wired unit to authenticate a user, and upon authentication, send a message to the access control system to open or close the safe. Such an embodiment may optionally store information regarding user access, duration of access and the like. In some embodiments, the mobile application may be configured to store biometric information for one or more users and provide and record access accordingly. In other embodiments, the biometric or other access control information may be stored locally. Some embodiment may also provide electrical power that can be obtained from the access control system to supply electrical power to the mobile device for battery recharge and uninterrupted use.

In some embodiments, memory may reside either on the device or in a remote system, such as a hard drive or other storage device in a computer, mobile phone, smart phone, tablet or cloud-based storage, to maintain records related to the storage device. These records may include but are not limited to contents of the storage, opening and closing of device, who opened and/or locked and/or closed the device, when and where the device was opened and/or closed. In some embodiments, this information may be transmitted to a third-party recipient, which may include but is not limited to doctors, nurses, insurance carriers, family members and other care-givers.

In some embodiments, the closure lid may optionally comprise an electronic port that may be used for wired data transfer and/or for powering the access control system and/or charging a battery supply that a powers the access control system. In such embodiments, the port may receive a micro USB or similar connector for data and power (e.g., a charging port) as known by those of skill in electronic connectors.

For embodiments where the access control system includes an electronic input (e.g., an identification input such as a biometric scanner), operation may be possible when the user contacts a hand or one or more fingers as input to the electronic controller, which is then read by the biometric scanner. The access control system may receive the biometric input of the user, compare the biometric input to the previously stored biometric input, and conditionally signals the lock to toggle state on location of a matching biometric record. In some embodiments, a user hand or fingerprints may be stored in memory of the electronic input. The access control system may be configured to receive biometric input data from a user, compare the received biometric input data, and transmit permission information to the lock in response to the comparison. The biometric data may be fingerprint data, and a biometric reader may be provided to read the data.

In a further aspect, a remote wireless input may be a radio-frequency identification (RFID) tag recognizable by the access control system comprising an RFID reader for authenticating the authorized user. Passive or active tags may be used, although passive tags do not require a battery supply and therefore may allow for a smaller design for the encapsulating medium. Accordingly, an Active Reader—Passive Tag (ARPT) system may be advantageous although other embodiments may be used. In one embodiment, the passive or active tag is a wearable tag. The wearable tag may be provided in an encapsulating medium that may take a variety of forms. In one embodiment, the encapsulating medium may be a laminar plastic substrate in the form of a card for convenient storage such as in a pocket, wallet, purse or the like. In another embodiment, the encapsulating medium may be a bracelet. In such embodiments, the access control system may receive the RFID tag as input of the user, compare input to the previously stored RFID records, and conditionally signals the lock to toggle state on location of a matching identity record.

Further embodiments of the system may provide the ability to automatically physically close the closure lid after a set amount of time that the user can set. In one embodiment, the closure lid may be closed via a servomotor activated in responses to a timer. The servomotor and the timer may be contained in the closure lid or the body of the storage device. In some embodiments, the ability to adjust settings, such as setting or controlling the timer or access to the closure lid may be performed locally on the actual device or remotely, for instance from a remote control device, such as but not limited to computer, mobile phone, smart phone, tablet, and the like.

Some embodiments of the secure storage device system may also include a position system such as GPS, geofencing, or the like. The system may display access to the container on a smartphone application or other computers and software. Additionally, the container may incorporate a speaker in communication with the smartphone application or other computers and software. The computer user can activate the process of the speaker emitting a sound, to facilitate locating the container.

For embodiments that include communications with a companion application on a smartphone or computer, for example, the application may have several different functionalities to control, communicate, and track interactions with the secure storage device of the present disclosure. For example, the application may include a main screen where a master password is required to access the different functionalities of the secure storage device. Once access is granted, a user may be able to use a locator function as described above to cause the storage device to beep until located. Some embodiments may include an alert function that notifies the user, via text or email, when the secure storage device has been opened, or if the device has not been closed after a pre-determined amount of time. The user may also be able to send a communication to the storage device to unlock and lock the mechanical lock integrated on the storage device. For example, a simple icon may be touched to unlock/lock the device, while other embodiments may require fingerprint identification on the application via a fingerprint scanner on the smartphone or computer to allow a pre-authorized and registered user to gain access to the secure storage device.

Several tracking features may also be available via the companion application, which may allow for administration of users, chain of custody reporting, and operation of the lock. For example, a history of access may be available that includes date, time, user identification (e.g., by name, user ID #, etc.). Each of the noted tracking identification fields may also be sortable to provide an administrator or owner with easy identification of access history by date, time, user, etc.

While exemplary embodiments are described above, it is not intended that these embodiments describe all possible forms. The words used in the specification are words of description rather than limitation, and it is understood that various changes may be made without departing from the scope of the disclosure. As previously described, the features of various embodiments may be combined to form further embodiments of the invention that may not be explicitly described or illustrated. While various embodiments may have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to: cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

Furthermore, the figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the principles of the present invention. As those of ordinary skill in the art will understand, various features illustrated and described with reference to any one of the figures may be combined with features illustrated in one or more other figures to produce embodiment that are not explicitly illustrated or described. The combinations of features illustrated provide representative embodiments for typical applications. Various combinations and modifications of the features consistent with the teachings of this disclosure, however, may be desired for particular applications or implementations.

The previous detailed description is of a small number of embodiments for implementing the invention, and is not intended to be limiting in scope. One of skill in the art may envisage methods, modifications, and variations used to implement the principles of the invention in other areas than those described in detail herein.

The invention claimed is:

1. A secure storage device for securely storing material, the secure storage device comprising:

a container having a divider and holders, the container dimensioned to fit inside of the secure storage device;

a closure lid similarly dimensioned to an opening of the container, wherein the closure lid is removable and is joined to the container utilizing locking tabs;

a control ring configured to turn clockwise when a user applies downward pressure; and a lock, wherein the lock conditionally restricts a change in state via an access control system, wherein the access control system is configured to present an input and conditionally allow the lock to change state.

2. The secure storage device according to claim 1, wherein the lock is a friction lock.

3. The secure storage device according to claim 1, wherein the lock is a mechanical lock.

4. The secure storage device according to claim 1, wherein the access control system and the lock comprise a key lock for receipt of a corresponding key as input.

5. The secure storage device according to claim 1, wherein the control ring turning clockwise engages and disengages the locking tabs with the container.

6. The secure storage device according to claim 1 further comprising:

a lock reset button provided in the closure lid.

7. The secure storage device according to claim 6, wherein the lock reset button is recessed in the closure lid.

8. The secure storage device according to claim 1, wherein the access control system is configured to:

receive biometric input data from a user;

compare the received biometric input data; and transmit permission information to the lock in response to said comparison.

9. The secure storage device according to claim 8, wherein the biometric input data is fingerprint data.

10. The secure storage device according to claim 1 further comprising:

a biometric reader in the access control system.

11. The secure storage device according to claim 1, wherein the container provides humidity control packs.

12. The secure storage device according to claim 11, wherein the container and the humidity control packs accommodate smart-enabled electronics.

13. A closure lid for a secure storage device, the closure lid comprising:

an access control system configured to present an input and conditionally allow the lock to change state;

a combination lock configured to conditionally restrict a change in state via the access control system;

a control ring configured to turn clockwise when a user applies downward pressure;

a lock reset button configured in a recessed position in the closure lid; and a plurality of locking tabs configured to deploy and un-deploy from the closure lid.

14. The closure lid according to claim 13, wherein the closure lid provides an ergonomic design and is safe to store in a refrigerator.

15. The closure lid according to claim 13, wherein the lock reset button prevents unintentionally resetting a combination lock password for locking the closure lid.

16. The closure lid according to claim 13, wherein the closure lid provides humidity control for medications and smart-enabled electronics.

17. The closure lid according to claim 13, wherein the closure lid is configured to provide an airtight seal with a container or an object in which the closure lid is applied.

18. The closure lid according to claim 17, wherein the airtight seal is provided without utilizing an vacuum pump and remains in a sealed position until released by a user.

19. The closure lid according to claim 17, wherein the closure lid provides an odor-free environment of the container or the object to which the closure lid is applied.

20. The closure lid according to claim 17, wherein the airtight seal is a single seal.

* * * * *